US010636548B2

(12) United States Patent
Zhang et al.

(10) Patent No.: US 10,636,548 B2
(45) Date of Patent: Apr. 28, 2020

(54) HOUSING STRUCTURE OF PLANAR RESISTOR

(71) Applicants: NR ENGINEERING CO., LTD, Nanjing, Jiangsu (CN); NR ELECTRIC CO., LTD, Nanjing, Jiangsu (CN); NR ELECTRIC POWER ELECTRONICS CO., LTD, Changzhou, Jiangsu (CN)

(72) Inventors: Xiang Zhang, Jiangsu (CN); Chihan Chen, Jiangsu (CN); Zhao Li, Jiangsu (CN); Ge Song, Jiangsu (CN); Li Zheng, Jiangsu (CN); Fan Yang, Jiangsu (CN)

(73) Assignees: NR ENGINEERING CO., LTD, Nanjing, Jiangsu (CN); NR ELECTRIC CO., LTD, Nanjing, Jiangsu (CN); NR ELECTRIC POWER ELECTRONICS CO., LTD, Changzhou, Jiangsu (CN)

( * ) Notice: Subject to any disclaimer, the term of this patent is extended or adjusted under 35 U.S.C. 154(b) by 0 days.

(21) Appl. No.: 16/331,134

(22) PCT Filed: Sep. 5, 2017

(86) PCT No.: PCT/CN2017/100451
§ 371 (c)(1),
(2) Date: Mar. 6, 2019

(87) PCT Pub. No.: WO2108/045935
PCT Pub. Date: Mar. 15, 2018

(65) Prior Publication Data

US 2019/0259513 A1 Aug. 22, 2019

(30) Foreign Application Priority Data

Sep. 7, 2016 (CN) ..... 2016 2 1043000 U

(51) Int. Cl.
*H01C 1/02* (2006.01)
*H01C 1/022* (2006.01)
*H01C 1/14* (2006.01)

(52) U.S. Cl.
CPC ..... *H01C 1/022* (2013.01); *H01C 1/02* (2013.01); *H01C 1/14* (2013.01)

(58) Field of Classification Search
CPC ..... H01C 1/022; H01C 1/14
(Continued)

(56) References Cited

U.S. PATENT DOCUMENTS 4,973,934 A * 11/1990 Saito ..... H01C 1/02 29/612
5,355,281 A * 10/1994 Adelmann ..... H01L 23/3735 257/707

FOREIGN PATENT DOCUMENTS

CN 201984912 U 9/2011
CN 201984915 U 9/2011
(Continued)

OTHER PUBLICATIONS

International Search Report, PCT/CN2017/100451 dated Dec. 7, 2017.
(Continued)

*Primary Examiner* — Kyung S Lee
*Assistant Examiner* — Iman Malakooti
(74) *Attorney, Agent, or Firm* — Young Basile Hanlon & MacFarlane, P.C.

(57) ABSTRACT

A housing structure of a planar resistor is provided, wherein electrode extraction ends of the planar resistor are on the same side of the resistor. A housing structure body is made of an insulating material covering the surface of the resistor. An insulating structure having a groove opening facing toward or away from the resistor is provided around each
(Continued)

electrode extraction end of the resistor. The insulating structure is configured to be a multi-tooth or multi-groove insulating structure.

22 Claims, 3 Drawing Sheets

(58) Field of Classification Search
USPC ..... 338/273
See application file for complete search history.

(56) References Cited

FOREIGN PATENT DOCUMENTS

| | | | | | |
|---|---|---|---|---|---|
| CN | 202758689 | U | | 2/2013 | |
| CN | 203300350 | U | | 11/2013 | |
| CN | 203774032 | | * | 8/2014 | ..... H01C 1/02 |
| CN | 203774032 | U | | 8/2014 | |
| CN | 206059059 | U | | 3/2017 | |
| EP | 1628331 | A1 | | 2/2006 | |

OTHER PUBLICATIONS

Extended European search report issued in corresponding European application No. 17848108.1 dated Jul. 23, 2019.

* cited by examiner

HOUSING STRUCTURE OF PLANAR RESISTOR

CROSS-REFERENCE TO RELATED APPLICATION(S)

This application is a 371 application of International Application No. PCT/CN2017/100451, filed on Sep. 5, 2017, which claims priority to Chinese Patent Application No. 201621043000.0, filed on Sep. 7, 2016, the disclosures of both of which are hereby incorporated by reference in their entireties.

TECHNICAL FIELD

The present disclosure relates to a housing structure of a planar resistor, more particularly to a housing structure of a voltage-sharing resistor for semiconductor switching elements in a valve module of a converter valve, and belongs to the field of power electronics.

BACKGROUND

To ensure the voltage balance of semiconductor switching elements in a converter valve, it is required to connect a resistor with a rated voltage of thousands of volts in parallel with them. Such a resistor is usually made by using a thick-film resistor in a shape of a flat cuboid with a bottom flat surface thereof tightly attached to a radiator, and is mounted in such a manner of being attached to an upper surface of the radiator and facing away from the ground, or mounted in such a manner of being attached to the lower surface of the radiator and facing toward the ground. Electrode extraction ends are all arranged on the same surface, and mounting wing plates are provided therearound for the convenience of fixation. The mounting wing plates and the resistor body can be reinforced by reinforcing ribs. Due to a large voltage difference and a short distance between the electrodes, an insulating material between the electrodes can be electrically polarized, resulting in that the surface of the insulating material in a particular area is electrically charged. In order to ensure enough insulating power, an insulation surface distance between the electrodes, namely, a creepage distance, needs to be increased.

At present, a common practice is to provide some vertical grooves or isolating walls on an insulating housing on the upper surface of a resistor. For example, the CN Design patent No. CN302578229S discloses a product, and a physical diagram of the product is as shown in FIG. 1, where the creepage distance is equal to a distance between electrodes plus a height of rising and falling of a groove or an isolating wall. Another practice is to extract electrodes a particular length by using high-voltage-resistant insulating wires, so that the creepage distance is equal to a distance between the electrodes plus the lengths of two leads. With regard to the connection of a planar resistor and a mounting wing plate, one or two vertical reinforcing ribs may be typically used for fastening.

The above practices have particular disadvantages. Regarding the first practice, dust and dirt may easily deposit in the groove and at the corners of the isolating wall after long-time running of the resistor, resulting in a decrease in creepage distance, which may affect the safety of the device. In addition, the dust and dirt in a narrow groove may be difficult to clear away completely during maintenance. Regarding the second practice, the use of the leads may result in an increase in overall footprint of the resistor, and due to a fixed wire length, it is inflexible in installation and use. With regard to the connection of the resistor body and a mounting wing plate, dust and dirt may easily deposit in a gap between reinforcing ribs, and corners between the reinforcing ribs and the wing plate and between the reinforcing ribs and the resistor body.

SUMMARY

The technical problem to be solved by the present disclosure is to overcome the defects in the above-mentioned related art and provide a housing structure that not only can satisfy the creepage distance of a resistor, but also can prevent fouling and dust.

A housing structure of a planar resistor is provided and characterized in that all electrode extraction ends of the planar resistor are on the same side and a body of the housing structure is made of an insulating material covering the surface of the resistor; further an insulating structure having an opening facing toward the resistor is disposed to surround the electrode extraction ends of the planar resistor.

Preferably, the structure is suitable for a resistor with electrode extraction ends mounted facing away from the ground or sidewise relative to the ground.

Another housing structure of a planar resistor is provided and characterized in that electrode extraction ends of the planar resistor are on the same side and a body of the housing structure is made of an insulating material covering the surface of the resistor; further, an insulating structure having an opening facing away from the resistor is disposed to surround the electrode extraction ends of the planar resistor.

Preferably, the structure is suitable for a resistor with electrode extraction ends mounted facing toward the ground.

In the above two kinds of housing structure, one end of the insulating structure is of a multi-tooth or multi-groove structure, and an outer top surface of the other end of the insulating structure is a flat surface. Preferably, a cross section of a tooth groove of the multi-tooth or multi-groove insulating structure is in a shape capable of increasing a creepage distance, including a square shape, a triangle shape or an arc shape.

Preferably, in the above two solutions, the insulating structure completely wraps around the electrodes, or wraps around electrodes within a partial region.

Preferably, in the above two solutions, the insulating structure is configured to be a structure of an insulating cover nut as a whole and allows inverted mounting according to an orientation of the electrode extraction ends.

Preferably, in the above two solutions, the insulating structure is constructed to surround two electrodes, or constructed between two electrodes.

Preferably, in the above two solutions, a housing of the planar resistor is provided with a mounting wing plate, and the connection of the mounting wing plate and the body of the planar resistor is reinforced by a circular arc or an inclined surface.

Compared with the above-mentioned related art, the tooth-groove structure increases the surface creepage distance of an insulating material between two electrodes. Since a groove-shaped opening always faces toward the ground or sidewise relative to the ground, dust and dirt can hardly enter the tooth-groove structure under the action of gravity. Therefore, reduction of the creepage distance caused by dust and dirt can be avoided, and the reliability and maintenance-free property of the resistor can be improved.

In the figures, what the numeral references represent are as described below:

1, an insulating material of a housing of a resistor body;
2, a mounting wing plate;
3, a multi-tooth or multi-groove insulating structure;
4, an electrode extraction end;
5, a reinforcing structure of the wing plate and the body;
6, a fastening screw for an extraction end connecting wire;
7, a resistor thin-film structure;
8, another multi-tooth or multi-groove insulating structure; and
9, another reinforcing structure of the wing plate and the body.

DETAILED DESCRIPTION

The present disclosure will be further introduced and described in combination with implementations, but the protection scope of the disclosure is not limited thereto.

Figure 1:
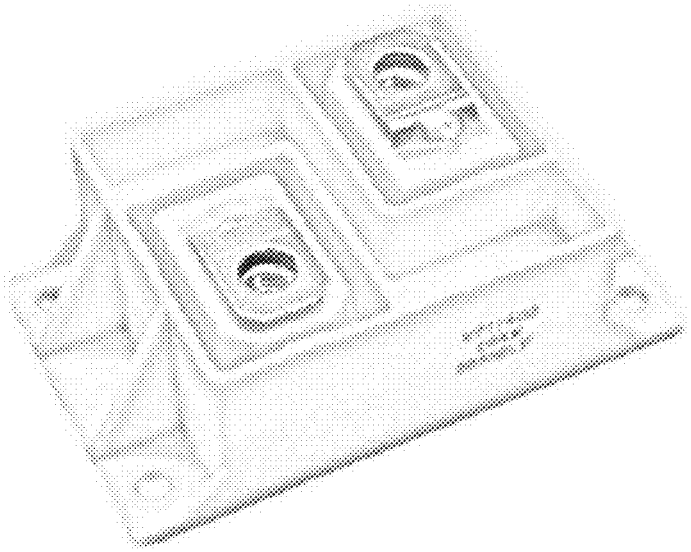
FIG. 1 is a physical diagram of a planar resistor in the prior art.
Figure 2:
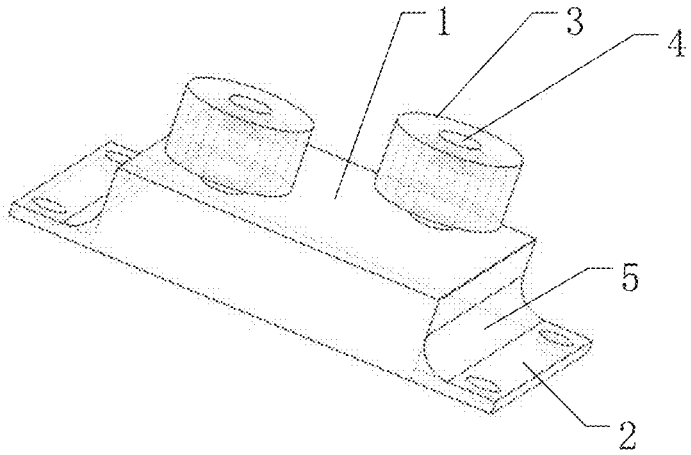
FIG. 2 is a three-dimensional diagram of an implementation of a housing structure of a planar resistor where electrodes are mounted facing away from the ground.
Figure 3:
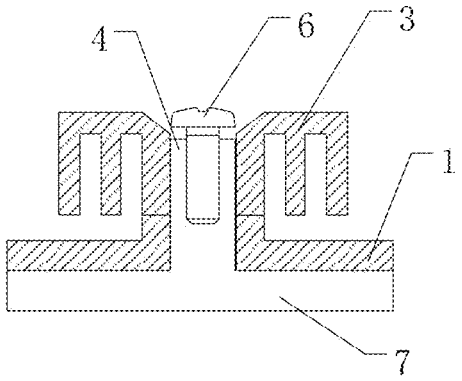
FIG. 3 is a partial cross-section diagram of an implementation of a housing structure of a planar resistor where electrodes are mounted facing away from the ground.

A housing structure of a planar resistor provided by this implementation is applied to a voltage-sharing resistor for semiconductor switching elements in a valve module of a converter valve. Referring to FIG. 2, the example resistor is mounted facing away from the ground, with all electrode extraction ends 4 arranged on the upper surface of the resistor. A housing structure body 1 is an insulating structure covering the surface of a resistor film 7. The electrode extraction ends 4 of the resistor are surrounded by a multi-tooth or multi-groove insulating structure 3 having an opening facing toward a resistor body, and a top surface of the structure 3 is a flat surface. Referring to the cross-section diagram of FIG. 3, the insulating structure 3 in this implementation has two tooth grooves, and the tooth tips and the tooth grooves are square in a cross-sectional view. An external connecting wire is fastened by a connecting wire fastening screw 6. In this implementation, the creepage distance of the electrode extraction ends 4 needs to stride over the upper surface of the multi-tooth or multi-groove insulating structure 3, then extend into the tooth grooves along the surface of the structure, and finally extend to the upper surface 1 of the resistor along an electrode insulating wall. With such a structure design, the creepage distance is significantly increased, and meanwhile, due to the fact that the opening of the multi-tooth or multi-groove insulating structure after installation faces toward the ground, dust and dirt are difficult to enter, so that the reliability and maintenance-free property of the resistor are guaranteed. In FIG. 1, the connection of a mounting wing plate 2 and the resistor body is reinforced by using an arc-shaped structure, so that the problem about dust and dirt depositing in vertical corners of rib plates and grooves between a plurality of rib plates when reinforcing ribs are used can be avoided. When the extraction ends of the resistor are mounted sidewise relative to the ground, the solution shown in this implementation can also be adopted.

In a further implementation, one end of the insulating structure is of other tooth-like or groove-like structure, and the outer top surface of the other end of the insulating structure can be a cambered surface or a waved surface.

In a further implementation, the cross sections of the tooth grooves and the tooth tips of the insulating structure can be triangular, arc-shaped, or in any other shape capable of increasing the creepage distance. The number of the tooth grooves of the insulating structure can be disposed arbitrarily.

Figure 4:
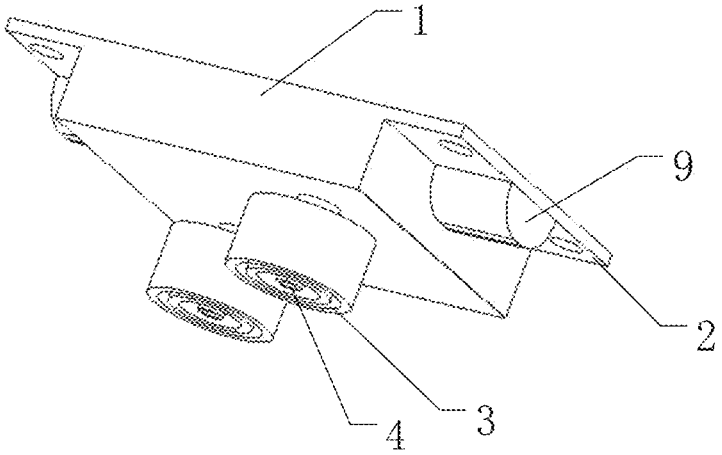
FIG. 4 is a three-dimensional diagram of an implementation of a housing structure of a planar resistor where electrodes are mounted facing toward the ground.

In a further implementation, when the electrode extraction ends of the resistor are arranged toward the ground, the multi-tooth or multi-groove insulating structure is designed to be inverted facing toward the outside of the resistor body, with the opening still facing toward the ground, as shown in FIG. 4. This implementation also provides another connection structure 9 of a wing plate and the resistor body.

In a further implementation, the insulating structure may only wrap around electrodes in a partial range, for example, only warp around the electrodes within a 180-degree range facing toward another electrode, with no inverted tooth groove disposed within the other 180-degree range. The insulating structure may be connected to an insulating housing on the upper surface of the resistor by using an ordinary insulating outer wall.

In a further implementation, the insulating structure can be a structure of an insulating cover nut as a whole and can be flexibly inverted and mounted according to a mounting orientation.

Figure 5:
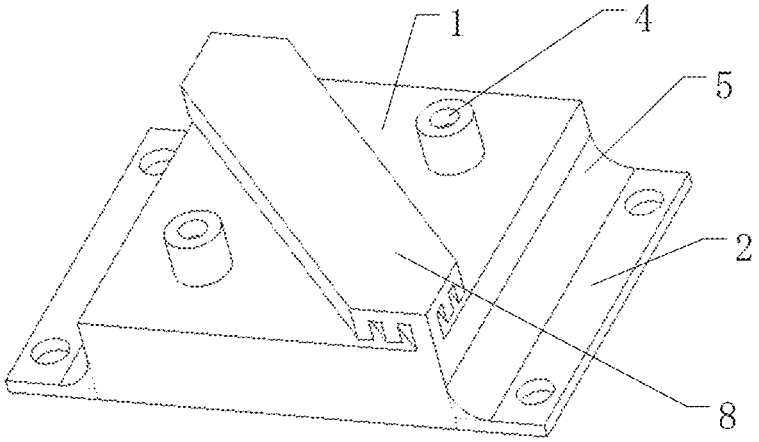
FIG. 5 is a three-dimensional diagram of another implementation of a housing structure of a planar resistor where electrodes are mounted facing away from the ground.
Figure 6:
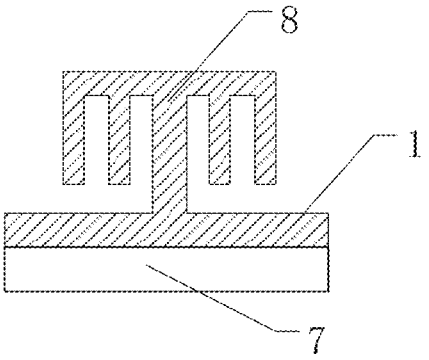
FIG. 6 is a partial cross-section diagram of another implementation of a housing structure of a planar resistor where electrodes are mounted facing away from the ground.

In another implementation, the insulating structure may be constructed at other locations between the electrodes of the planar resistor. As shown in FIG. 5, the electrodes 4 are still wrapped with an ordinary insulating structure with a smooth outer surface, and a multi-tooth or multi-groove insulating structure 8 is designed at a center line position between two electrodes of the resistor. As shown in the cross-section diagram of FIG. 6, the structure is in a shape of a tree or an umbrella.

The housing structure of the planar resistor provided in the present disclosure is characterized in that the creepage distance between the electrodes of the planar resistor is increased by using an insulating structure having a multi-tooth or multi-groove feature, and meanwhile, according to a mounting orientation of the electrodes, the opening of the multi-tooth or multi-groove insulating structure is always kept to face toward the ground or be sidewise relative to the ground, thereby preventing dust and fouling and enhancing the reliability and maintenance-free property of the planar resistor. Variations and modifications can be made by those skilled in the art within the scope of the claims of the present disclosure, which shall all fall into the protection scope of the disclosure as long as they are not beyond the scope of the claims.

What is claimed is:

1. A housing structure of a planar resistor, wherein all electrode extraction ends of the planar resistor are on the same side; a body of the housing structure is made of an insulating material covering a surface of the resistor; an insulating structure having a groove opening facing toward the resistor is disposed to surround the electrode extraction ends of the planar resistor; one end of the groove opening of the insulating structure is of a multi-tooth or multi-groove structure, and an outer top surface of the other end of the insulating structure is a flat surface or a cambered surface or a waved surface; and the opening of the multi-tooth or multi-groove structure after installation faces toward the ground.

2. A housing structure of a planar resistor, wherein electrode extraction ends of the planar resistor are on the same side; a body of the housing structure is made of an insulating material covering a surface of the resistor; an insulating structure having a groove opening facing away from the resistor is disposed to surround the electrode extraction ends of the planar resistor; one end of the groove opening of the insulating structure is of a multi-tooth or multi-groove structure, and an outer top surface of the other end of the insulating structure is a flat surface or a cambered surface or a waved surface; and the opening of the multi-tooth or multi-groove structure after installation faces toward the ground.

3. The housing structure of the planar resistor according to claim 1, wherein a cross section of a tooth groove of the multi-tooth or multi-groove insulating structure is in a shape capable of increasing a creepage distance, including a square shape, a triangle shape or an arc shape.

4. The housing structure of the planar resistor according to claim 1, wherein the structure is suitable for a resistor with electrode extraction ends mounted facing away from the ground or sidewise relative to the ground.

5. The housing structure of the planar resistor according to claim 1, wherein the insulating structure completely wraps around the electrodes, or wraps around the electrodes within a partial region.

6. A housing structure of a planar resistor, wherein all electrode extraction ends of the planar resistor are on the same side; a body of the housing structure is made of an insulating material covering a surface of the resistor; an insulating structure having a groove opening facing toward the resistor is disposed to surround the electrode extraction ends of the planar resistor; and the insulating structure is configured to be a structure of an insulating cover nut as a whole and allows inverted mounting according to an orientation of the electrode extraction ends.

7. The housing structure of the planar resistor according to claim 1, wherein the insulating structure is constructed to surround two electrodes, or constructed between two electrodes.

8. The housing structure of the planar resistor according to claim 1, wherein a housing of the planar resistor is provided with a mounting wing plate, and a connection of the mounting wing plate and the body of the planar resistor are reinforced by a circular arc or an inclined surface.

9. The housing structure of the planar resistor according to claim 2, wherein a cross section of a tooth groove of the multi-tooth or multi-groove insulating structure is in a shape capable of increasing a creepage distance, including a square shape, a triangle shape or an arc shape.

10. The housing structure of the planar resistor according to claim 2, wherein the structure is suitable for a resistor with electrode extraction ends mounted facing toward the ground.

11. The housing structure of the planar resistor according to claim 2, wherein the insulating structure completely wraps around the electrodes, or wraps around electrodes within a partial region.

12. A housing structure of a planar resistor, wherein electrode extraction ends of the planar resistor are on the same side; a body of the housing structure is made of an insulating material covering a surface of the resistor; an insulating structure having a groove opening facing away from the resistor is disposed to surround the electrode extraction ends of the planar resistor; and the insulating structure is configured to be a structure of an insulating cover nut as a whole and allows inverted mounting according to an orientation of the electrode extraction ends.

13. The housing structure of the planar resistor according to claim 2, wherein the insulating structure is constructed to surround two electrodes, or constructed between two electrodes.

14. The housing structure of the planar resistor according to claim 2, wherein a housing of the planar resistor is provided with a mounting wing plate, and the connection of the mounting wing plate and the body of the planar resistor is reinforced by a circular arc or an inclined surface.

15. The housing structure of the planar resistor according to claim 6, wherein the structure is suitable for a resistor with electrode extraction ends mounted facing away from the ground or sidewise relative to the ground.

16. The housing structure of the planar resistor according to claim 6, wherein the insulating structure completely wraps around the electrodes, or wraps around the electrodes within a partial region.

17. The housing structure of the planar resistor according to claim 6, wherein the insulating structure is constructed to surround two electrodes.

18. The housing structure of the planar resistor according to claim 6, wherein a housing of the planar resistor is provided with a mounting wing plate, and a connection of the mounting wing plate and the body of the planar resistor is reinforced by a circular arc or an inclined surface.

19. The housing structure of the planar resistor according to claim 12, wherein the structure is suitable for a resistor with electrode extraction ends mounted facing toward the ground.

20. The housing structure of the planar resistor according to claim 12, wherein the insulating structure completely wraps around the electrodes, or wraps around electrodes within a partial region.

21. The housing structure of the planar resistor according to claim 12, wherein the insulating structure is constructed to surround two electrodes.

22. The housing structure of the planar resistor according to claim 12, wherein a housing of the planar resistor is provided with a mounting wing plate, and the connection of the mounting wing plate and the body of the planar resistor is reinforced by a circular arc or an inclined surface.

* * * * *